US010273766B1

(12) United States Patent
Batista et al.

(10) Patent No.: US 10,273,766 B1
(45) Date of Patent: Apr. 30, 2019

(54) PLUG AND PLAY CONNECTION SYSTEM FOR A BELOW-TENSION-RING MANAGED PRESSURE DRILLING SYSTEM

(71) Applicant: JLE INOVAÇAO TECNOLOGICA LTDA EPP, Copacabana, Rio de Janeiro (BR)

(72) Inventors: Jorge Chami Batista, Rio de Janeiro (BR); Leandro Diniz Brandao Rocha, Rio de Janeiro (BR); Jose Eugenio de Almeida Campos, Aracaju (BR)

(73) Assignee: JLE INOVAÇAO TECNOLOGICA LTDA EPP, Copacabana (BR)

( * ) Notice: Subject to any disclaimer, the term of this patent is extended or adjusted under 35 U.S.C. 154(b) by 0 days.

(21) Appl. No.: 16/130,263

(22) Filed: Sep. 13, 2018

Related U.S. Application Data

(60) Provisional application No. 62/640,128, filed on Mar. 8, 2018.

(51) Int. Cl.

| | |
|---|---|
| ***E21B 7/18*** | (2006.01) |
| ***E21B 17/08*** | (2006.01) |
| ***E21B 19/00*** | (2006.01) |
| ***E21B 21/00*** | (2006.01) |
| ***E21B 21/01*** | (2006.01) |
| ***E21B 21/12*** | (2006.01) |
| ***E21B 43/01*** | (2006.01) |

(52) U.S. Cl.
CPC ..... *E21B 21/01* (2013.01); *E21B 7/185* (2013.01); *E21B 19/004* (2013.01); *E21B 21/001* (2013.01); *E21B 21/12* (2013.01); *E21B 17/085* (2013.01); *E21B 43/0107* (2013.01); *E21B 2021/007* (2013.01)

(58) Field of Classification Search
CPC ..... E21B 21/01; E21B 21/12; E21B 19/004; E21B 21/001; E21B 7/185; E21B 17/085; E21B 43/0107; E21B 2021/007
See application file for complete search history.

(56) References Cited

U.S. PATENT DOCUMENTS 3,606,393 A * 9/1971 Huntsinger et al. .. E21B 17/085 285/308
4,403,658 A * 9/1983 Watkins ..... E21B 7/128 166/355

(Continued)

*Primary Examiner* — James G Sayre
(74) *Attorney, Agent, or Firm* — Basil M. Angelo; Angelo IP

(57) ABSTRACT

A plug and play connection system for a managed pressure drilling system includes a connection hub flange disposed around an outer surface of an outer barrel of a telescopic joint that includes a plurality of pass-through ports and a plurality of connection hub flange ports. A connection hub ring is removably disposed around an outer surface of the connection hub flange. The connection hub ring includes a plurality of dogs configured to removably attach the connection hub ring to the outer surface of the connection hub flange and a plurality of stab-in connectors disposed around an outer surface of the connection hub ring. A ported bottom flange is connected to a bottom distal end of the outer barrel of the telescopic joint and includes a plurality of bottom flange ports. A plurality of conduits connect the plurality of connection hub flange ports to the plurality of bottom flange ports.

17 Claims, 8 Drawing Sheets

(56) References Cited

U.S. PATENT DOCUMENTS 4,592,426 A * 6/1986 Neely ..... E21B 17/01 166/344
4,712,620 A * 12/1987 Lim ..... E21B 19/006 166/355
5,348,351 A * 9/1994 LaFleur ..... E21B 17/02 285/110
5,727,630 A * 3/1998 Brammer ..... E21B 17/085 166/355
6,263,982 B1 * 7/2001 Hannegan ..... E21B 21/001 175/195
6,530,430 B2 * 3/2003 Reynolds ..... E21B 19/006 166/346
7,571,772 B2 8/2009 Reams
8,474,538 B2 * 7/2013 Wallace ..... E21B 19/006 166/339
2007/0063507 A1 * 3/2007 Reams ..... E21B 17/01 285/39
2007/0169540 A1 * 7/2007 Sterner ..... E21B 21/01 73/19.09
2009/0236144 A1 * 9/2009 Todd ..... E21B 17/01 175/5
2011/0005769 A1 * 1/2011 Robichaux ..... E21B 17/05 166/358
2011/0008099 A1 * 1/2011 Larson ..... E21B 19/004 403/27
2011/0073315 A1 * 3/2011 Guesnon ..... E21B 17/085 166/367
2013/0092388 A1 * 4/2013 Gilmore ..... E21B 17/01 166/367
2014/0083711 A1 * 3/2014 Springett ..... E21B 19/004 166/345
2014/0209316 A1 * 7/2014 Tindle ..... E21B 33/035 166/345
2014/0262313 A1 * 9/2014 Gilmore ..... E21B 33/085 166/363
2015/0167404 A1 * 6/2015 Hoefler ..... E21B 19/004 166/360
2015/0337607 A1 * 11/2015 Latimer ..... E21B 17/017 166/345
2016/0076312 A1 * 3/2016 Fraczek ..... E21B 19/002 166/367
2016/0273280 A1 * 9/2016 Ptak ..... E21B 17/085
2017/0159377 A1 * 6/2017 Salem ..... E21B 17/085
2017/0298702 A1 * 10/2017 Glawion ..... E21B 17/05

* cited by examiner

PLUG AND PLAY CONNECTION SYSTEM FOR A BELOW-TENSION-RING MANAGED PRESSURE DRILLING SYSTEM

CROSS-REFERENCE TO RELATED APPLICATIONS

This application claims the benefit of, or priority to, U.S. Provisional Patent Application Ser. No. 62/640,128, filed on Mar. 8, 2018, which is hereby incorporated by reference in its entirety.

BACKGROUND OF THE INVENTION

Conventional open-loop hydraulic drilling systems manage bottomhole pressure ("BHP") by adjusting the equivalent circulating density ("ECD") of the fluids, sometimes referred to as mud, disposed within the wellbore. The ECD is the effective fluid density exerted by a circulating fluid against the formation that takes into account the circulating frictional pressure on the fluids returning to the surface and is a function of the injection rate of the mud pumps, the properties of the injected fluids, and the true vertical depth of the wellbore. Under static conditions, when circulation is suspended, circulating frictional pressure is lost and the BHP tends to drop. In narrow pressure windows, this drop may cause the BHP to fall below the pore pressure, potentially inducing a kick, or unintentional influx of formation fluids, into the wellbore. In such circumstances, to prevent a kick, heavier mud weight fluids may be used to maintain the BHP at a pressure higher than that of the pore pressure of the formation. As such, the driller must pay careful attention to the ECD and pressure profile of the wellbore during all drilling operations including drilling, making connections, and tripping into and out of the hole.

In contrast, closed-loop hydraulic drilling systems manage BHP by adjusting the choke settings of a choke manifold, typically disposed on a platform of the floating drilling rig, as part of a pressurized fluid return system. A rotating control device, active control device, or other annular sealing system seals the annulus surrounding the drill string or drill pipe and returning fluids are diverted to the choke manifold. Because the annulus is sealed pressure tight, surface backpressure may be applied and controlled by adjusting the choke settings of the choke manifold. Under static conditions, when drilling ceases, surface backpressure may be provided by the choke manifold, instead of using fluids with heavier mud weights, to maintain the BHP above the pore pressure of the formation. In addition to preventing kicks, and alleviating a number of pressure related drilling problems, the closed annular system with pressurized fluid returns, sometimes referred to generally as a managed pressure drilling ("MPD") system, allows for the accurate control of annular pressure during all drilling operations including drilling, making connections, and tripping into and out of the hole, as well as completions.

BRIEF SUMMARY OF THE INVENTION

According to one aspect of one or more embodiments of the present invention, a plug and play connection system for a managed pressure drilling system includes a connection hub flange disposed around an outer surface of an outer barrel of a telescopic joint that includes a plurality of pass-through ports and a plurality of connection hub flange ports. A connection hub ring is removably disposed around an outer surface of the connection hub flange. The connection hub ring includes a plurality of dogs configured to removably attach the connection hub ring to the outer surface of the connection hub flange and a plurality of stab-in connectors disposed around an outer surface of the connection hub ring. A ported bottom flange is connected to a bottom distal end of the outer barrel of the telescopic joint and includes a plurality of bottom flange ports. A plurality of conduits connect the plurality of connection hub flange ports to the plurality of bottom flange ports. The plurality of stab-in connectors are connected to the plurality of connection hub flange ports by the plurality of pass-through ports.

According to one aspect of one or more embodiments of the present invention, a plug and play connection system riser joint for a managed pressure drilling system includes an inner barrel having an inner barrel central lumen and an outer barrel having an outer barrel central lumen. The inner barrel is configured to reciprocate within the outer barrel and the inner barrel central lumen is in fluid communication with the outer barrel central lumen. A packer is disposed at a top distal end of the outer barrel and is configured to seal an annulus between the inner barrel and the outer barrel as the inner barrel reciprocates. A tension ring is configured to support the packer. A connection hub flange is disposed around an outer surface of the outer barrel and includes a plurality of pass-through ports and a plurality of hub flange ports. A connection hub ring is removably disposed around an outer surface of the connection hub flange and includes a plurality of dogs configured to removably attach the connection hub ring to the outer surface of the connection hub flange and a plurality of stab-in connectors disposed around an outer surface of the connection hub ring. A bearing ring is configured to movably attach the connection hub ring to the tension ring. A ported bottom flange is connected to the bottom distal end of the outer barrel and includes a plurality of bottom flange ports. A plurality of conduits connect the plurality of connection hub flange ports to the plurality of bottom flange ports. The plurality of stab-in connectors are connected to the plurality of connection hub flange ports by the plurality of pass-through ports.

According to one aspect of one or more embodiments of the present invention, a method of retrofitting a managed pressure drilling system for use with a plug and play connection system includes attaching a connection hub flange to an outer barrel of a telescopic joint, attaching a ported bottom flange to a bottom portion of the telescopic joint, connecting a plurality of hub flange ports of the connection hub flange to a plurality of bottom flange ports of the ported bottom flange with a plurality of conduits, attaching a first side of a bearing ring to a bottom side of a tension ring, attaching a second side of the bearing ring to a top side of a connection hub ring, disposing the tension ring, bearing ring, and connection hub ring around the telescopic joint below a packer of the telescopic joint, connecting a plurality of drape hoses that connect a plurality of stab-in connectors of the connection hub ring to equipment disposed on a platform of the floating drilling rig, and actuating the plurality of stab-in connectors.

Other aspects of the present invention will be apparent from the following description and claims.

DETAILED DESCRIPTION OF THE INVENTION

Figure 1:
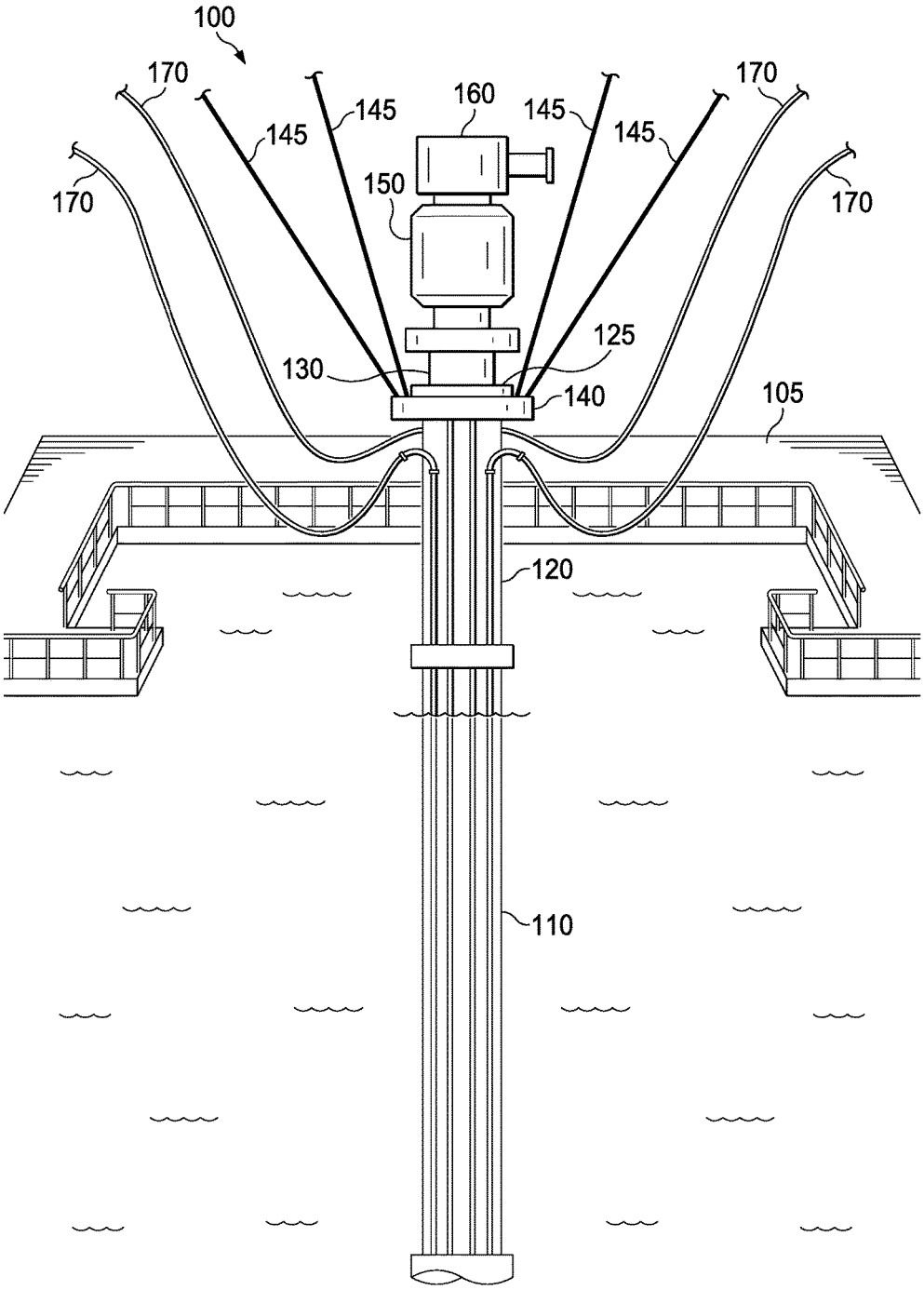
FIG. 1 PRIOR ART
FIG. 1 shows an upper marine riser system of a conventional open-loop hydraulic drilling system.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

Closed-loop hydraulic drilling systems find application in both onshore and offshore wells, however, MPD systems are increasingly being used, and in some cases required, in deepwater and ultra-deepwater offshore applications including, but not limited to, underbalanced drilling ("UBD") applications, applied surface backpressure ("ASBP")-MPD drilling applications, pressurized mud cap drilling ("PMCD") applications, floating mud cap drilling ("FMCD") applications, depleted reservoir drilling applications, and narrow pressure window drilling applications. Advantageously, MPD technology may prevent borehole problems including stuck pipe, lost circulation, and poor wellbore stability. In addition, fewer casings strings and mud weight changes are required. As such, MPD technology allows for continuous drilling of longer sections and deeper wells, improving well economics and potentially making marginal, or even uneconomic, fields profitable to develop. The precise management of pressure allows for early kick detection, reduces kick volume, minimizes kick loss cycles, and allows for better control of shallow gas and water flow. In this way, MPD technology improves safety by minimizing blowouts and other well control situations that are typically encountered in an open-atmosphere system.

For these reasons, and others, MPD technology is increasingly being used in offshore applications, especially in deepwater and ultra-deepwater applications. However, despite its technical superiority, there has been resistance to the adoption of MPD technology, such that it is, at present, only deployed when absolutely necessary for technical or regulatory reasons or financially worthwhile, a decision that is typically taken prior to drilling and which depends on the characteristics of a given well. Although there are costs associated with MPD technology, the primary cost hindering wide-scale adoption of MPD technology relates to the time and labor intensive costs associated with installing and removing a group of heavy and lengthy drape hoses that connect various bottomhole systems and components of the MPD system to equipment disposed on the platform of the floating drilling rig. Even when MPD systems are deployed, there are substantial costs, including non-productive downtime, associated with disconnecting various drape hoses to, for example, service or change a bearing or seal assembly of a rotating or active control device respectively. As such, there is a long-felt and unsolved need in the industry to simplify the deployment and operation of MPD systems and to enable the economic retrofitting of existing MPD system installations for plug and play operation.

Accordingly, in one or more embodiments of the present invention, a plug and play connection system for a managed pressure drilling system enables plug and play operation with respect to drape hoses and connectivity to the MPD system, the subsea blowout preventer ("SSBOP"), and other equipment disposed on or near the subsea surface. The plug and play connection system allows for the rapid connection or disconnection of equipment on the floating drilling rig to the MPD system, the SSBOP, or other equipment disposed on or near the subsea surface. The connections or disconnections may be made safely, quickly and, easily in advance.

In one or more embodiments of the present invention, one or more drape hose connections to a connection hub ring of the plug and play connection system may be made prior to the SSBOP run. Prior to the floating drilling rig arriving at the location of the well, the connection hub ring may be installed, hanging attached to the tension ring, in the moon pool area. One or more drape hose connections may already connect the connection hub ring to equipment disposed on the floating drilling rig prior to arrival. After the SSBOP run, the marine riser and MPD system may be installed and the plug and play connection system may be used to facilitate connections and disconnections between equipment on the floating drilling rig and the MPD system, the SSBOP, or other equipment disposed on or near the subsea surface. After drilling operations are completed, the floating drilling rig may then be moved to another location. Advantageously, all drape hose connections may remain intact during the relocation, expediting the commencement of the next drilling operation.

In one or more embodiments of the present invention, once installed, components of the plug and play connection system, as well as components of the MPD system itself, may be more easily installed, serviced, pulled, or replaced. In certain embodiments, a plug and play connection system may be deployed as part of an integrated riser joint. In other embodiments, an existing installation of an upper marine riser system may be retrofitted to perform as a plug and play connection system. Advantageously, such embodiments reduce equipment costs, labor costs, and costs associated with non-productive downtime resulting from installing, servicing, pulling, or replacing various components of an upper marine riser system or MPD system, including, but not limited to, the telescopic joint, the rotating control device, active control device, drill-string isolation tool, flow spool, or components thereof. In all such embodiments, the safety of operations is improved by the centralized ability to connect or disconnect one or more drape hoses used as part of the MPD system.

FIG. 1 shows an upper marine riser system 100 of a conventional open-loop hydraulic drilling system. A floating drilling rig (not independently illustrated) disposed on a body of water may be used to drill a wellbore (not shown) into the subsea surface (not shown) to recover hydrocarbons (not shown) disposed therein. The floating drilling rig (not independently illustrated) may be a semi-submersible, a drillship (not shown), a drill barge (not shown), or any other type or kind of floating platform or rig that is buoyant and is subjected to the heave of the body of water in which it is disposed. The moon pool area 105 of the floating drilling rig (not independently illustrated) provides access to the upper marine riser system 100. The upper marine riser system 100 may include a flow diverter 160 disposed on top of, and in fluid communication with, a flex joint 150. Flex joint 150 may be disposed on top of, and in fluid communication with, an inner barrel 130 of a telescopic joint (e.g., 120, 125, and 130), sometimes referred to as a slip joint. Inner barrel 130 is in fluid connection with an outer barrel 120 of the telescopic joint (e.g., 120, 125, and 130). Outer barrel 120 includes a packer 125 disposed at a top distal end that is configured to seal an annulus (not shown) between outer barrel 120 and inner barrel 130. Inner barrel 130 is configured to reciprocate within an inner diameter of outer barrel 120 to accommodate motion of the floating drilling rig (not independently illustrated) relative to the relatively stationary portion of the upper marine riser system 100 disposed below the telescopic joint (e.g., 120, 125, and 130) and marine riser system 110 due to heave of the body of water in which the floating drilling rig (not independently illustrated) is disposed.

A tension ring 140 and a plurality of tension cables 145 provide support to outer barrel 120 of the telescopic joint (e.g., 120, 125, and 130) and any portion of the upper marine riser system 100 and marine riser system 110 disposed below it. The plurality of tension cables 145 connect to tensioners (not shown) disposed on the floating drilling rig (not independently illustrated) and maintain tension as the floating drilling rig (not independently illustrated) heaves relative to the comparatively stationary portion of the upper marine riser system 100 disposed below the telescopic joint (e.g., 120, 125, and 130) and marine riser system 110. Outer barrel 120 is in fluid communication with the marine riser system 110 that traverses the water depth and connects to a SSBOP (not shown) disposed at or near the subsea surface (not shown). Marine riser system 110 refers generally to the one or more tubulars or piping that connects the upper marine riser system 100 to the SSBOP (not shown) or other equipment disposed at or near the subsea surface (not shown).

The SSBOP (not shown) is disposed over, and in fluid communication with, a wellbore (not shown) drilled into the subsea surface (not shown). A central lumen, or interior passageway, extends through upper marine riser system 100, marine riser system 110 that traverses the water depth, the SSBOP (not shown), and into the wellbore (not shown) to facilitate drilling operations. A plurality of fixed lines, disposed on an exterior surface of marine riser system 110, connect the SSBOP (not shown) or other equipment (not shown) disposed on or near the subsea surface (not shown) to the telescopic joint (e.g., 120, 125, and 130). A plurality of drape hoses 170 connect the plurality of fixed lines to equipment disposed on the floating drilling rig (not independently illustrated). The fixed lines may include, for example, a kill line, a choke line, a booster line, and a plurality of hydraulic lines. The plurality of drape hoses 170 are attached below tension ring 140 and include sufficient slack to accommodate the heaving motion of the floating drilling rig (not independently illustrated) relative to the comparatively stationary portion of the upper marine riser system 100 and marine riser system 110.

If the operator wishes to convert the conventional open-loop hydraulic drilling system depicted in FIG. 1, or similar system, to a closed-loop hydraulic drilling system, such as, for example, that depicted in FIG. 2, a below-tension-ring MPD system (not shown) is installed between outer barrel 120 of the telescopic joint (e.g., 120, 125, and 130) and a top portion of marine riser system 110. Such a conversion requires removal of a substantial portion of upper marine riser system 100 in a time-consuming, expensive, and potentially dangerous operation that results in substantial non-productive downtime. As such, the decision to use an MPD system (not shown) is usually taken early in the project, prior to deployment of the marine riser system, and operators are reluctant to convert an existing conventional open-loop hydraulic drilling system once deployed.

Figure 2:
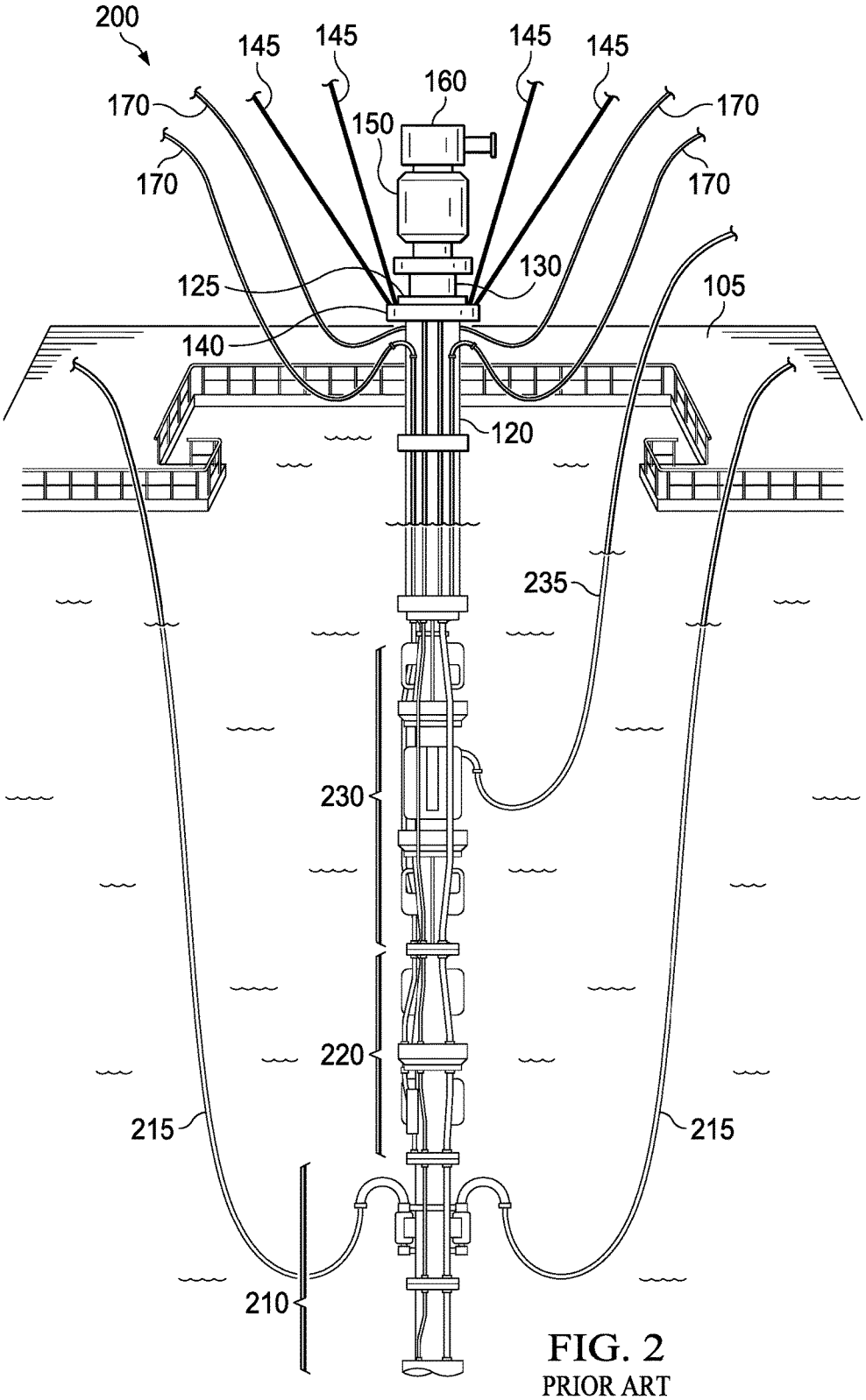
FIG. 2 PRIOR ART
FIG. 2 shows an upper marine riser system of a conventional below-tension-ring closed-loop hydraulic drilling system.

FIG. 2 shows an upper marine riser system 200 of a conventional below-tension-ring closed-loop hydraulic drilling system. A floating drilling rig (not independently illustrated) may be used to drill a wellbore (not shown) into the subsea surface (not shown) to recover hydrocarbons (not shown) disposed therein. The moon pool area 105 of the floating drilling rig (not independently illustrated) provides access to the upper marine riser system 200. Upper marine riser system 200 may include a flow diverter 160 disposed on top of, and in fluid communication with, a flex joint 150. Flex joint 150 may be disposed on top of, and in fluid communication with, an inner barrel 130 of a telescopic joint (e.g., 120, 125, and 130). Inner barrel 130 is in fluid connection with an outer barrel 120 of the telescopic joint (e.g., 120, 125, and 130). Outer barrel 120 includes a packer 125 disposed at a top distal end that is configured to seal an annulus (not shown) between outer barrel 120 and inner barrel 130. Inner barrel 130 is configured to reciprocate within an inner diameter of outer barrel 120 to accommodate motion of the floating drilling rig (not independently illustrated) relative to the comparatively stationary MPD system (e.g., 210, 220, and 230) and marine riser system (e.g., 110 not shown, but disposed below 210) due to the heave of the body of water in which the floating drilling rig (not independently illustrated) is disposed. A tension ring 140 and a plurality of tension cables 145 provide support to outer barrel 120 of the telescopic joint (e.g., 120, 125, and 130), the MPD system (e.g., 210, 220, and 230), and the marine riser system (e.g., 110 not shown) disposed below it. The plurality of tension cables 145 connect to tensioners (not shown) disposed on the floating drilling rig (not independently illustrated) and maintain tension as the floating drilling rig (not independently illustrated) heaves relative to the comparatively stationary MPD system (e.g., 210, 220, and 230) and marine riser system (e.g., 110 not shown, but disposed below 210).

Outer barrel 120 is in communication with an annular sealing system 230 of an MPD system (e.g., 210, 220, and 230). Annular sealing system 230 controllably seals the annulus surrounding a drill string (not shown) disposed therethrough. Annular sealing system 230 may be a rotating control device (not shown), an active control device, or other type of annular seal (not shown). A relief hose 235 may relieve or provide pressure between sealing elements (not shown) of annular sealing system 230 or between annular sealing system 230 and drill string isolation tool 220 during, for example, replacement of a sealing element (not shown) of the annular sealing system 230. Annular sealing system 230 is controllably in fluid communication with a drill string isolation tool 220 that provides an additional annular seal that allows the drill string (not shown) to be isolated when needed. For example, if annular sealing system 230 requires service, the sealing element (not shown), such as a packer (not shown), of drill string isolation tool 220 may be engaged to maintain the pressure tight seal on the annular, at which point the annular sealing system 230 may be serviced.

Drill string isolation tool 220 is in fluid communication with a flow spool 210 disposed below the annular seal 230 and drill string isolation tool 220. Flow spool 210 includes a plurality of flow spool drape hoses 215 that connect to a choke manifold (not shown) disposed on the floating drilling rig (not independently illustrated). Because the annulus surrounding the drill string (not shown) is sealed pressure tight, wellbore pressure may be controlled by the degree to which one or more chokes (not shown) of the choke manifold (not shown) are opened or closed. In this way, wellbore pressure may be precisely maintained at a desired level without requiring the use of varying mud weights. The choke manifold (not shown) is typically connected to a mud-gas separator (not shown) or other fluids systems (not shown) disposed on the floating drilling rig (not independently illustrated) that are used to remove dangerous gas (not shown) from the marine riser system (e.g., 110 not shown).

A marine riser system (e.g., 110 not shown) traverses the water depth and connects flow spool 210 to a SSBOP (not shown) disposed at or near the subsea surface (not shown). The marine riser system (e.g., 110 not shown) refers generally to one or more tubulars or piping that connects the MPD system (e.g., 210, 220, and 230) to the SSBOP (not shown). The SSBOP (not shown) is disposed over, and in fluid communication with, a wellbore (not shown) drilled into the subsea surface (not shown). A central lumen, or interior passageway, extends through upper marine riser system 200, the MPD system (e.g., 210, 220, and 230), the marine riser system (e.g., 110 not shown) that traverses the water depth, the SSBOP (not shown), and into the wellbore (not shown) to facilitate drilling operations. One of ordinary skill in the art will recognize that the equipment used to maintain the annular seal and pressurized fluid return are commonly referred to in the industry as the MPD system (e.g., 210, 220, and 230) and may include one or more of the above-noted components and other components not specifically disclosed, but well known in the art.

In addition to relief hose 235 and flow spool drape hoses 215, a plurality of fixed lines, disposed on an exterior surface of the marine riser system (e.g., 110 not shown), connect the SSBOP (not shown) to the marine riser system (e.g., 110 not shown), the MPD system (e.g., 210, 220, and 230), and upper marine riser system 200. A plurality of drape hoses 170 connect the plurality of fixed lines to equipment disposed on the floating drilling rig (not independently illustrated). The fixed lines may include, for example, a kill line, a choke line, a booster line, and a plurality of hydraulic lines. The plurality of drape hoses 170 are connected below tension ring 140 and include sufficient slack to accommodate the heaving motion of the floating drilling rig (not independently illustrated) relative to the comparatively stationary MPD system (e.g., 210, 220, and 230) and marine riser system riser (e.g., 110 not shown). One or more of the drape hoses 170 or fixed lines may be umbilicals (not shown), used to connect equipment (not shown) disposed on the floating drilling rig (not independently illustrated) to one or more of annular sealing system 230, drill string isolation tool 220, flow spool 210, or the SSBOP (not shown) or other equipment (not shown) disposed on or near the seafloor. These umbilicals are typically routed outside of the bottom flange of the telescopic joint (e.g., 120, 125, and 130). When a component of the MPD system (e.g., 210, 220, and 230) requires service, installation, to be pulled, or to be replaced, one or more drape hoses (e.g., 170, 215, and 235) may have to be disconnected and then reconnected once the necessary work has been performed. Because certain drape hoses (e.g., 215 and 235) may be connected to one or more components of the MPD system (e.g., 210 and 230) disposed underwater, complicated, dangerous, and costly operations must be undertaken to connect or disconnect them, including potentially, dive or robotic operations. In addition, there is substantial non-productive downtime whenever such operations are undertaken.

Figure 3A:
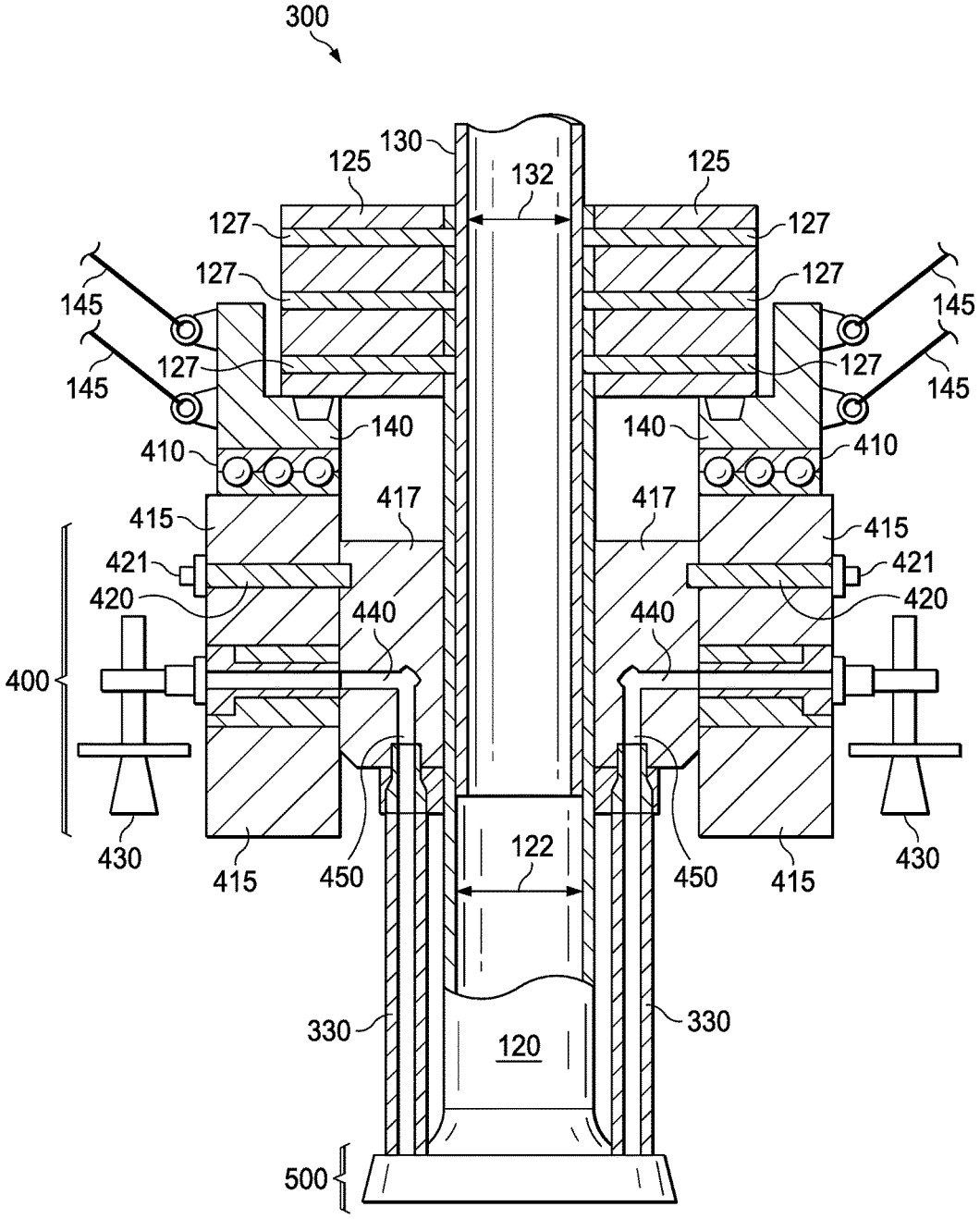
FIG. 3A shows a cross-sectional view of a plug and play connection system for a managed pressure drilling system in accordance with one or more embodiments of the present invention.

FIG. 3A shows a cross-sectional view of a plug and play connection system 300 (or a portion of a plug and play connection system 300 riser joint) for a managed pressure drilling system in accordance with one or more embodiments of the present invention.

In certain embodiments, a plug and play connection system 300 may be installed on an MPD system to facilitate plug and play operation. Plug and play connection system 300 may include a connection hub flange 417 disposed around an outer surface of an outer barrel 120 of a telescopic joint (e.g., 120, 125, and 130). In certain embodiments, connection hub flange 417 may be welded, or otherwise fixedly attached, to outer barrel 120. In other embodiments, connection hub flange 417 may be fabricated as a unitary part of outer barrel 120. Connection hub flange 417 may include a plurality of pass-through ports 440 connected to a corresponding plurality of hub flange ports 450 disposed on a distal end of connection hub flange 417. The plurality of hub flange ports 450 may be oriented along a longitudinal axis of outer barrel 120 of the telescopic joint (e.g., 120, 125, and 130).

Plug and play connection system 300 may also include a connection hub ring 400 removably disposed around an outer surface of connection hub flange 417. Connection hub ring 400 may include a plurality of dogs 420, substantially disposed in housing 415, that are configured to controllably and removably attach connection hub ring 400 to the outer surface of connection hub flange 417. The plurality of dogs 420 may be hydraulically or mechanically actuated via a plurality of actuation ports 421 that are configured to deploy or retract the plurality of dogs 420 into or out of a corresponding receiving profile of connection hub flange 417. As such, connection hub ring 400 may controllably secure or release its connection to or from connection hub flange 417. Connection hub ring 400 may include a plurality of stab-in connectors 430 disposed around an outer surface (e.g., housing 415) of connection hub ring 400. The plurality of stab-in connectors 430 may be oriented and distributed around the outer surface of connection hub ring 400 in a manner suitable for a particular application or design. As such, one of ordinary skill in the art will recognize that the number of stab-in connectors 430, as well as their type, kind, size, shape, orientation, and distribution may vary based on an application or design in accordance with one or more embodiments of the present invention.

Plug and play connection system 300 may also include a bearing ring 410 configured to movably attach connection hub ring 400 to a tension ring 140 that supports a packer 125 of the telescopic joint (e.g., 120, 125, and 130). A first side of bearing ring 410 may be welded, or otherwise fixedly attached, to a bottom side of tension ring 140 and a second side of bearing ring 410 may be welded, or otherwise fixedly attached, to a top side of connection hub ring 400. Bearing ring 410 may be configured to allow for rotational movement between tension ring 140 and connection hub ring 400. During installation and removal, the freedom of rotational movement helps achieve proper alignment of connection hub ring 400 with connection hub flange 417 such that the stab-in connectors 430 of connection hub ring 400 may be aligned with their corresponding pass-through ports 440 of connection hub flange 417 for communication.

Plug and play connection system 300 may also include a ported bottom flange 500 connected to a bottom distal end of outer barrel 120. Ported bottom flange 500 may include a plurality of bottom flange ports (not shown) that traverse ported bottom flange 500 for further plug and play connectivity, directly or indirectly, to corresponding connections (not shown) of, for example, an annular sealing system (not shown) or other component of an MPD system (not shown) disposed directly below it. The annular sealing system (not shown) may include a modified top flange (not shown) configured to mate with the bottom flange ports (not shown) of ported bottom flange 500 to facilitate plug and play operation.

Plug and play connection system 300 may also include a plurality of conduits 330 that connect the plurality of connection hub flange ports 450 to the corresponding plurality of bottom flange ports (not shown). The plurality of stab-in connectors 430 may connect to the plurality of connection hub flange ports 450 by way of the plurality of pass-through ports 440 within connection hub flange 417.

Plug and play connection system 300 may also include a plurality of drape hoses (not shown), each of which has a first distal end connected to a stab-in connector (e.g., 430) and a second distal end connected to a device or system (not shown) disposed on a platform (not shown) of the floating rig (not shown). The plurality of stab-in connectors 430, pass-through ports 440, hub flange ports 450, conduits 330, and bottom flange ports (not shown) form a plurality of communication lines (not independently illustrated) that may be used to connect one or more fluid lines, hydraulic lines, umbilicals, or combinations thereof. Because the plurality of stab-in connectors 430 are disposed around connection hub ring 400, all connections between equipment disposed on the platform (not shown) of the drilling rig (not shown) may be safely and easily made or removed, as needed, in the moon pool area (e.g., 105 of FIG. 5). Notwithstanding the above, such connections may be made in advance of deployment of the plug and play connection system 300 as part of the MPD system (not shown), but in such instances, connections and disconnections may be made, as needed, in the moon pool area (e.g., 105 of FIG. 5).

In other embodiments, a plug and play connection system 300 may be configured as a riser joint for rapid installation, service, and removal and to facilitate plug and play operation. Plug and play connection system 300 riser joint may include a top flange (not shown) attached to a top distal end of inner barrel 130. The top flange (not shown) may be used to connect the riser joint to equipment disposed above it in the upper marine riser system (not shown), including, for example, a flex joint (e.g., 150). Inner barrel 130 may include an inner barrel central lumen 132, or interior passageway, having a first diameter, through which the drill string or other equipment (not shown) may be removably disposed. Outer barrel 120 may include an outer barrel central lumen 122 having a second diameter larger than the inner barrel 130. Inner barrel 130 may be configured to reciprocate, in a telescoping manner, within outer barrel 120, such that the inner barrel central lumen 132 remains in fluid communication with the outer barrel central lumen 122 regardless of the extent to which inner barrel 130 is displaced within outer barrel 120 due to heave. A packer 125 may be disposed at or near a top distal end of outer barrel 120 that is configured to seal an annulus between inner barrel 130 and outer barrel 120 of the telescopic joint (e.g., 120, 125, and 130) as the inner barrel 130 reciprocates. Specifically, packer 125 may include a plurality of seals 127 that seal the annulus between inner barrel 130 and outer barrel 120 as inner barrel 130 reciprocates within outer barrel 120. A tension ring 140 may be disposed around, and supports or is secured to, an outer surface of packer 125. Tension ring 140 may have a profile configured to cradle and support packer 125 to support the weight of the equipment disposed below it.

Plug and play connection system 300 riser joint may also include a connection hub flange 417 disposed around an outer surface of outer barrel 120 of the telescopic joint (e.g., 120, 125, and 130). In certain embodiments, connection hub flange 417 may be welded, or otherwise fixedly attached, to outer barrel 120. In other embodiments, connection hub flange 417 may be fabricated as a unitary part of outer barrel 120. Connection hub flange 417 may include a plurality of pass-through ports 440 connected to a corresponding plurality of hub flange ports 450 disposed on a distal end of connection hub flange 417. The plurality of hub flange ports 450 may be oriented along a longitudinal axis of outer barrel 120 of the telescopic joint (e.g., 120, 125, and 130).

Plug and play connection system 300 riser joint may also include a connection hub ring 400 removably disposed around an outer surface of connection hub flange 417. Connection hub ring 400 may include a plurality of dogs 420, substantially disposed in housing 415, that are configured to controllably and removably attach connection hub ring 400 to the outer surface of connection hub flange 417. The plurality of dogs 420 may be hydraulically or mechanically actuated via a plurality of actuation ports 421 that are configured to deploy or retract the plurality of dogs 420 into or out of a corresponding receiving profile of connection hub flange 417. As such, connection hub ring 400 may controllably secure or release its connection to or from connection hub flange 417. Connection hub ring 400 may include a plurality of stab-in connectors 430 disposed around an outer surface (e.g., housing 415) of connection hub ring 400. The plurality of stab-in connectors 430 may be oriented and distributed around the outer surface of connection hub ring 400 in a manner suitable for a particular application or design. As such, one of ordinary skill in the art will recognize that the number of stab-in connectors 430, as well as their type, kind, size, shape, orientation, and distribution may vary based on an application or design in accordance with one or more embodiments of the present invention.

Plug and play connection system 300 riser joint may also include a bearing ring 410 configured to movably attach connection hub ring 400 to tension ring 140 that supports a packer 125 of the telescopic joint (e.g., 120, 125, and 130). A first side of bearing ring 410 may be welded, or otherwise fixedly attached, to a bottom side of tension ring 140 and a second side of bearing ring 410 may be welded, or otherwise fixedly attached, to a top side of connection hub ring 400. Bearing ring 410 may be configured to allow for rotational movement between tension ring 140 and connection hub ring 400. During installation and removal, the freedom of rotational movement helps achieve proper alignment of connection hub ring 400 with connection hub flange 417 such that the stab-in connectors 430 of connection hub ring 400 may be aligned with their corresponding pass-through ports 440 of connection hub flange 417 for communication.

Plug and play connection system 300 riser joint may also include a ported bottom flange 500 connected to a bottom distal end of outer barrel 120. Ported bottom flange 500 may include a plurality of bottom flange ports (not shown) that traverse ported bottom flange 500 for further plug and play connectivity, directly or indirectly, to corresponding connections (not shown) of, for example, an annular sealing system (not shown) or other component of an MPD system (not shown) disposed directly below it. The annular sealing system (not shown) may include a modified top flange (not shown) configured to mate with the bottom flange ports (not shown) of ported bottom flange 500 to facilitate plug and play operation.

Plug and play connection system 300 riser joint may also include a plurality of conduits 330 that may connect the plurality of connection hub flange ports 450 to the corresponding plurality of bottom flange ports (not shown). The plurality of stab-in connectors may connect to the plurality of connection hub flange ports 450 by way of the plurality of pass-through ports 440 within connection hub flange 417.

Plug and play connection system 300 riser joint may also include a plurality of drape hoses (not shown), each of which has a first distal end connected to a stab-in connector (e.g., 430) and a second distal end connected to a device or system (not shown) disposed on a platform (not shown) of the floating rig (not shown). The plurality of stab-in connectors 430, pass-through ports 440, hub flange ports 450, conduits 330, and bottom flange ports (not shown) form a plurality of communication lines (not independently illustrated) that may be used to connect one or more fluid lines, hydraulic lines, umbilicals, or combinations thereof. Because the plurality of stab-in connectors 430 are disposed around connection hub ring 400, all connections between equipment disposed on the platform (not shown) of the drilling rig (not shown) may be safely and easily made or removed, as needed, in the moon pool area (e.g., 105 of FIG. 5). Notwithstanding the above, such connections may be made in advance of deployment of the plug and play connection system 300 as part of the MPD system (not shown), but in such instances, connections and disconnections may be made, as needed, in the moon pool area (e.g., 105 of FIG. 5).

In still other embodiments, a plug and play connection system 300 may be installed on an MPD system (not shown) in the field to facilitate plug and play operation. The floating drilling rig (not shown) is typically floating on the sea and positioned over the wellbore. Typically, tension ring 140 is already in place in the moon pool area (not shown) under the rotary table. Connection hub ring 400 may, by way of bearing ring 410, be fixedly attached to tension ring 140. The plurality of drape hoses (not shown), potentially including one or more umbilicals, may connect equipment (not shown) disposed on the floating drilling rig (not shown) to the plurality of stab-in connectors 430 of connection hub ring 400. The SSBOP (not shown) may be positioned under tension ring 140 and connection hub ring 400, all aligned with the rotary table (not shown). The marine riser (not shown) may be deployed through the rotary table (not shown), tension ring 140, and connection hub ring 400 and may be connected to the lower flex joint (not shown) at the top of the SSBOP (not shown). The SSBOP (not shown) run may start as other marine riser (not shown) segments are successively connected one after the other and the SSBOP (not shown) is directed down toward the subsea wellbore. The riser-gas-handling, or MPD, system (e.g., 210, 220, and 230 of FIG. 2) may be connected to the marine riser system (not shown) when the SSBOP (not shown) is near the wellbore. The telescopic joint (e.g., 120, 125, and 130), specifically, ported bottom flange 500 of outer barrel 120, may be connected, directly or indirectly, to the top most component of the riser gas handling, or MPD, system (e.g., 210, 220, and 230 of FIG. 2). All lines (e.g., 330) and umbilicals (e.g., 330) may be set as fixed lines pre-connected to the MPD system (e.g., 210, 220, and 230 of FIG. 2) and run up fixed to a top most flange of the MPD system (e.g., 210, 220, and 230 of FIG. 2), such as, for example, a custom top flange (not shown) of the annular sealing system (e.g., 230 of FIG. 2) configured to communicate with ported bottom flange 500 of plug and play connection system 300. The telescopic joint (e.g., 120, 125, and 130) may be rotated to align all auxiliary lines such as, for example, kill line, choke line, or booster line, to connection hub ring 400 before packer 125 of outer barrel 120 of the telescopic joint (e.g., 120, 125, and 130) comes to rest on tension ring 140. This horizontal alignment may be achieved using the kill and choke lines as a reference, while the clock of the other lines may vary based on an application or design. The vertical alignment is warranted when the telescopic joint (e.g., 120, 125, and 130) rests on tension ring 140 by the vertical measure of the equipment. Once the lines, by way of pass-through ports 440, are aligned with their stab-in connectors 430, the dogs (not shown) of the telescopic joint (e.g., 120, 125, and 130) are hydraulically or otherwise actuated to lock the telescopic joint (e.g., 120, 125, and 130) to tension ring 140. Then the plurality of dogs 420 of connection hub ring 400 may be hydraulically or otherwise actuated to secure connection hub ring 400 to connection hub flange 417 that is fixedly attached to outer barrel 120 of the telescopic joint (e.g., 120, 125, and 130). As such, the fixed lines of the telescopic joint (e.g., 120, 125, and 130) are aligned and thus ready for connection by way of stab-in connectors 430 of connection hub ring 400. The stab-in connectors 430 may be hydraulically or otherwise activated with at least double sealing redundancies. The fixed lines from the SSBOP (not shown) and the MPD system (e.g., 210, 220, and 230 of FIG. 2) are then ready for testing before the SSBOP (not shown) is attached to the wellhead (not shown).

Figure 3B:
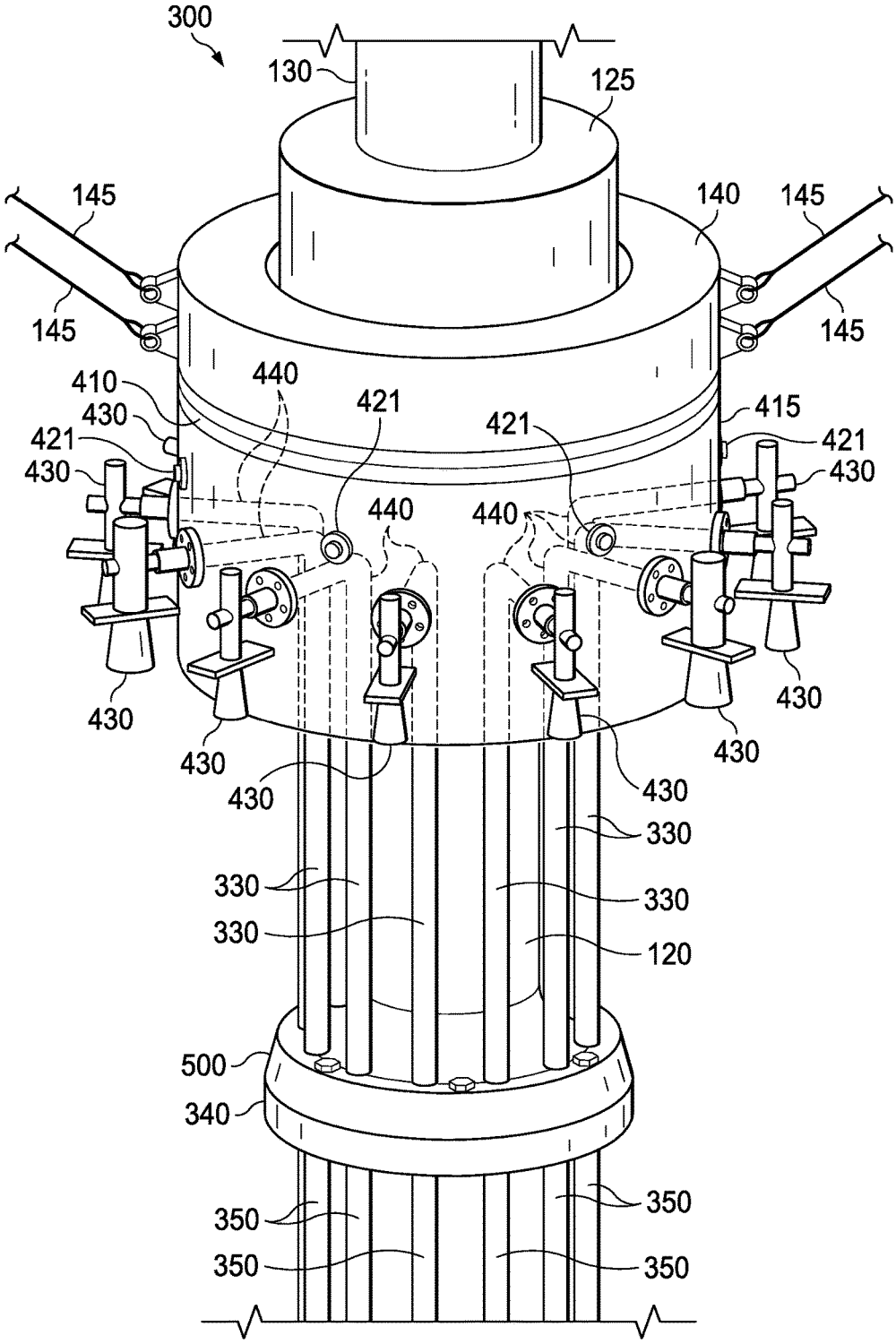
FIG. 3B shows a top-facing perspective view of a portion of a plug and play connection system riser joint for a managed pressure drilling system in accordance with one or more embodiments of the present invention.

Continuing, FIG. 3B shows a top-facing perspective view of a portion of a plug and play connection system 300 riser joint for managed pressure drilling system in accordance with one or more embodiments of the present invention. In this perspective view, the distribution of the plurality of stab-in connectors 430 around housing 415 of connection hub ring 400 (of one exemplary embodiment) is shown. One of ordinary skill in the art will recognize that the number of stab-in connectors 430, as well as their type, kind, size, shape, orientation, and distribution may vary based on an application or design in accordance with one or more embodiments of the present invention. Each stab-in connector 430 may connect via a corresponding pass-through port 440, disposed within the connection hub flange (not independently illustrated) of outer barrel 120, to a corresponding plurality of hub flange ports (e.g., 450 of FIG. 3A) disposed on a distal end of the connection hub flange. Each hub port (e.g., 450 of FIG. 3A) may connect via a corresponding conduit 330 to a corresponding bottom flange port (not independently illustrated) of ported bottom flange 500. The plurality of bottom flange ports (not independently illustrated) may traverse ported bottom flange 500 for connection to the equipment disposed below ported bottom flange 500 in the MPD system (not shown) or marine riser system (not shown). One of ordinary skill in the art will recognize that top flange 340 may include a clock of ports that allow for the routing of lines and umbilicals originating from the SSBOP (not shown) or MPD system (not shown) as needed based on a particular application or design.

Figure 4A:
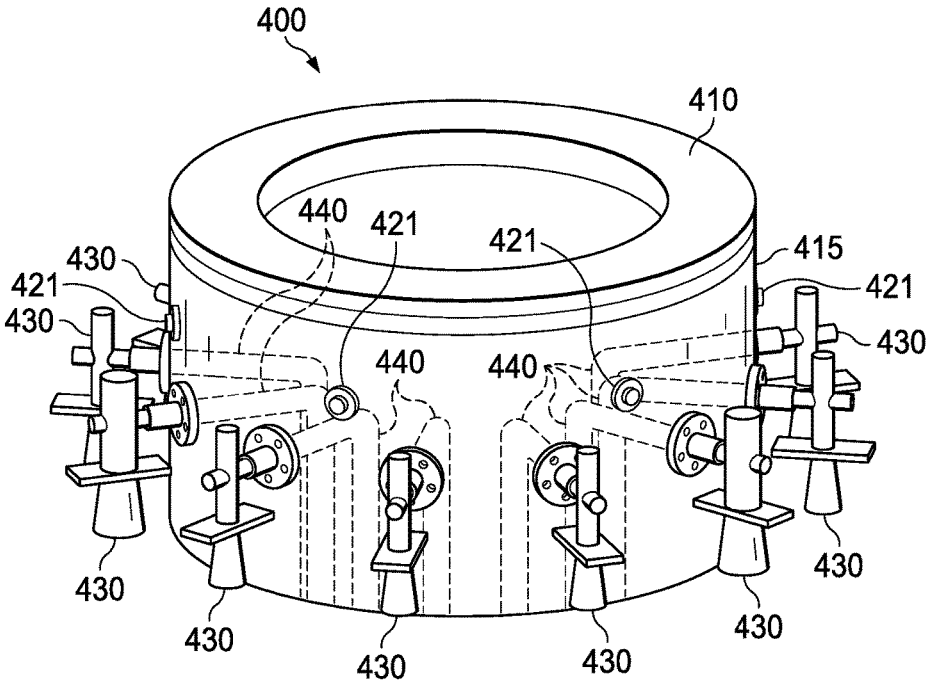
FIG. 4A shows a top-facing perspective view of a connection hub ring of a plug and play connection system for a managed pressure drilling system in accordance with one or more embodiments of the present invention.

FIG. 4A shows a top-facing perspective view of a connection hub ring 400 and bearing ring 410 of a plug and play connection system (e.g., 300 of FIG. 3) for a managed pressure drilling system in accordance with one or more embodiments of the present invention. A plug and play connection system (e.g., 300 of FIG. 3) may include a connection hub ring 400, a connection hub flange (e.g., 417 of FIG. 3A), a ported bottom flange (e.g., 500 of FIG. 4C), and a plurality of conduits (e.g., 330 of FIG. 3B) that connect the plurality of hub flange ports (not shown) of the connection hub flange (e.g., 417 of FIG. 3A) to the plurality of bottom flange ports (not shown) of the ported bottom flange (e.g., 500 of FIG. 4C). The plurality of bottom flange ports (not shown) may be used to connect the plug and play connection system (e.g., 300 of FIG. 3) to equipment disposed below the telescopic joint (not shown).

As previously discussed, a bearing ring 410 may be fixedly attached to a top side of connection hub ring 400 and a bottom side of a tension ring (e.g., 140 of FIG. 3A). A first side of bearing ring 410 may be welded, or otherwise fixedly attached, to a bottom side of tension ring 140 and a second side of bearing ring 410 may be welded, or otherwise fixedly attached, to a top side of connection hub ring 400. Bearing ring 410 may be configured to allow for rotational movement between tension ring 140 and connection hub ring 400.

Connection hub ring 400 may include a plurality of dogs (e.g., 420 of FIG. 3A), substantially disposed in housing 415, that may be configured to controllably attach connection hub ring 400 to the outer surface of the connection hub flange (e.g., 417 of FIG. 3A). The plurality of dogs (e.g., 420 of FIG. 3A) may be hydraulically or mechanically actuated via a plurality of actuation ports 421 that are configured to deploy or retract the plurality of dogs (e.g., 420 of FIG. 3A) into or out of a corresponding receiving profile of the connection hub flange (e.g., 417 of FIG. 3A). As such, connection hub ring 400 may controllably secure or release its connection to or from the connection hub flange (e.g., 417 of FIG. 3A).

Connection hub ring 400 may also include a plurality of stab-in connectors 430 disposed around an outer surface (e.g., housing 415) of connection hub ring 400. The plurality of stab-in connectors 430 may be oriented and distributed around the outer surface of connection hub ring 400 in a manner suitable for a particular application or design. As such, one of ordinary skill in the art will recognize that the number of stab-in connectors 430, as well as their type, kind, size, shape, orientation, and distribution may vary based on an application or design in accordance with one or more embodiments of the present invention.

Figure 4B:
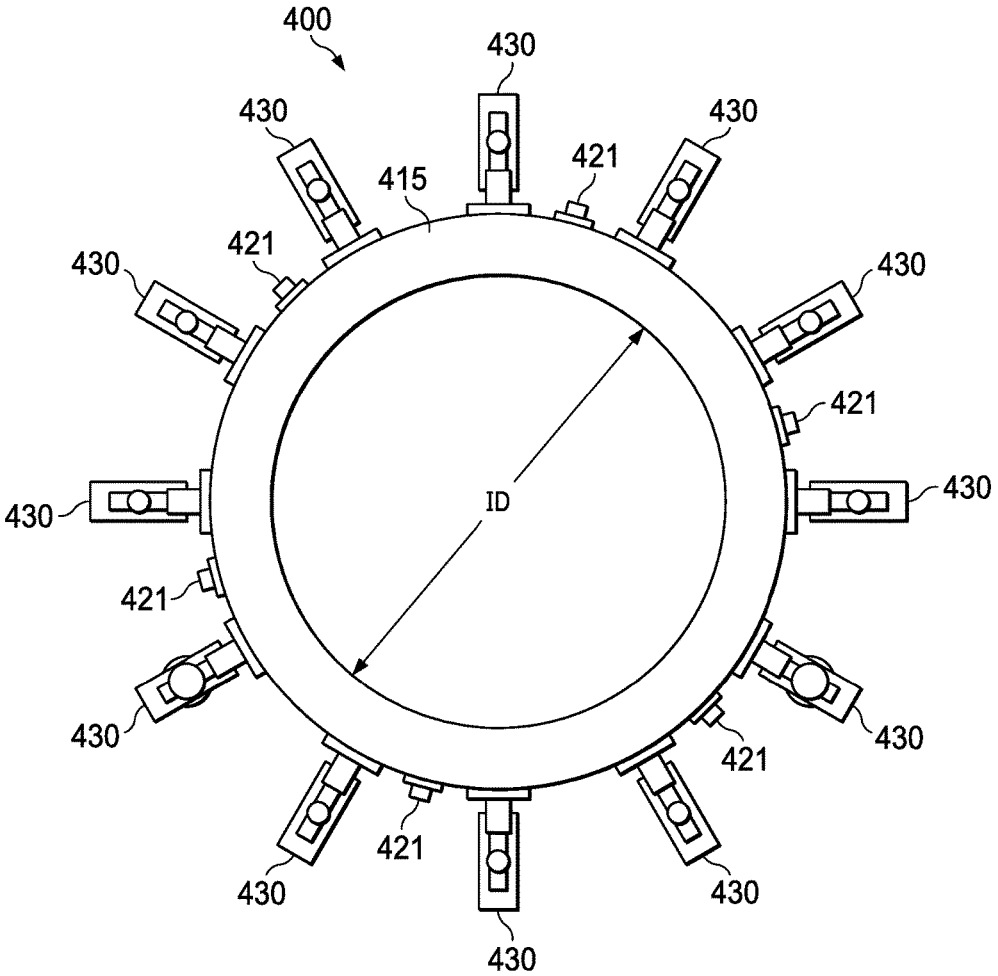
FIG. 4B shows a top plan view of a connection hub ring of a plug and play connection system for a managed pressure drilling system in accordance with one or more embodiments of the present invention.

Continuing, FIG. 4B shows a top plan view of connection hub ring 400 of the plug and play connection system (e.g., 300 of FIG. 3) for a managed pressure drilling system in accordance with one or more embodiments of the present invention. In this view, a distribution of stab-in connectors 430 and dog-actuated ports 421 are shown as being evenly spaced about the outer diameter of connection hub ring 400. However, one of ordinary skill in the art will recognize that the number of stab-in connectors 430 and dog actuation ports 421, as well as their type, kind, size, shape, orientation, and distribution may vary based on an application or design in accordance with one or more embodiments of the present invention. Additionally, one of ordinary skill in the art will also recognize that the inner diameter, ID, may vary based on an application or design in accordance with one or more embodiments of the present invention.

Figure 4C:
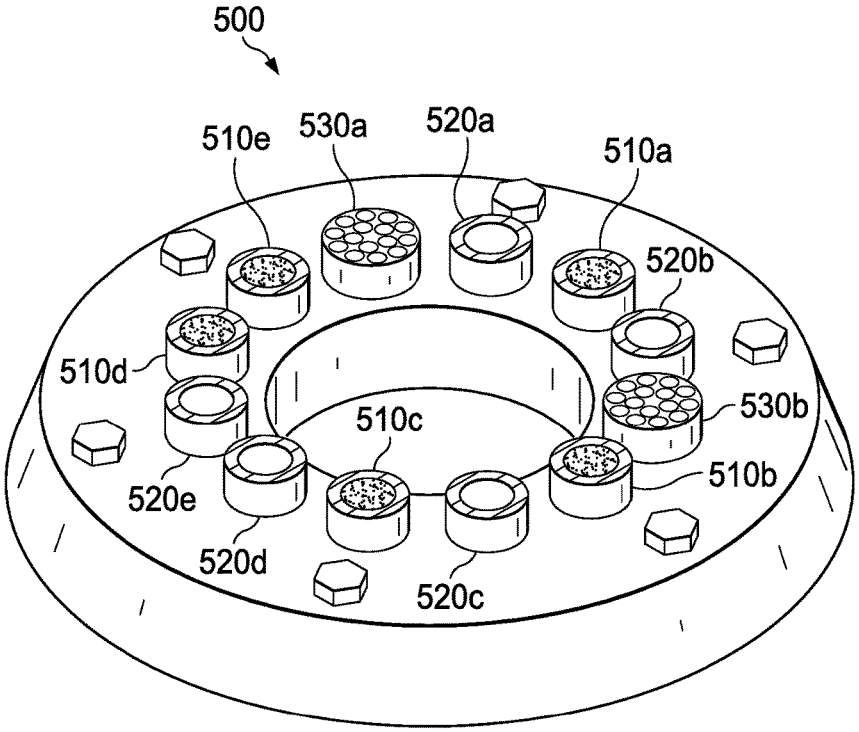
FIG. 4C shows a top-facing perspective view of a ported bottom flange of a plug and play connection system for a managed pressure drilling system in accordance with one or more embodiments of the present invention.

Continuing, FIG. 4C shows a top-facing perspective view of a ported bottom flange 500 of a plug and play connection system (e.g., 300 of FIG. 3) for a managed pressure drilling system in accordance with one or more embodiments of the present invention. In one or more embodiments of the present invention, ported bottom flange 500 may include a plurality of bottom flange ports (e.g., 510, 520, and 530) that traverse and pass through ported bottom flange 500. The plurality of bottom flange ports 510*a*, 510*b*, 510*c*, 510*d*, and 510*e* may include one or more of a choke line, a kill line, a booster line, and one or more hydraulic lines that ultimately connect to the SSBOP (not shown). The plurality of bottom flange ports 520*a*, 520*b*, 520*c*, 520*d*, and 520*e* may include one or more relief lines, lubrication lines, flow diverter lines, circulation lines, and other hydraulic lines. The plurality of bottom flange ports 530*a* and 530*b* may be one or more umbilical connection ports for one or more of a bearing umbilical, a rotating control device umbilical, an active control device umbilical, a control umbilical, a valve umbilical, or any other type or kind of umbilical that may need to traverse the marine riser system (not shown).

The plurality of bottom flange ports (e.g., 510, 520, and 530) of ported bottom flange 500 may be configured for plug and play connection, directly or indirectly, to the corresponding connections (not shown) of an annular sealing system (not shown), or other device, disposed directly below it. One or more of the bottom flange ports (e.g., 510, 520, and 530) of ported bottom flange 500 may connect to one or more of a choke line, a kill line, a booster line, and one or more hydraulic lines of the SSBOP (not shown) or other equipment disposed at or near the subsea surface of a wellbore (not shown). One or more of the bottom flange ports (e.g., 510, 520, and 530) of ported bottom flange 500 may connect to one or more relief lines, lubricating lines, flow diverter lines, circulation lines, and other hydraulic lines. One or more of the bottom flange ports (e.g., 510, 520, and 530) of ported bottom flange 500 may connect to one or more of a bearing umbilical, a rotating control device umbilical, an active control device umbilical, a control umbilical, a valve umbilical, or any other type or kind of umbilical that may traverse the marine riser system (not shown). The annular sealing system (not shown) may include a modified top flange (not shown) configured to mate with the bottom flange ports (e.g., 510, 520, and 530) of ported bottom flange 500 when connected together for plug and play operation.

One of ordinary skill in the art will recognize that the type, kind, size, shape, and number, as well as the clock orientation, of bottom flange ports may vary based on an application or design in accordance with one or more embodiments in the present invention.

Figure 5:
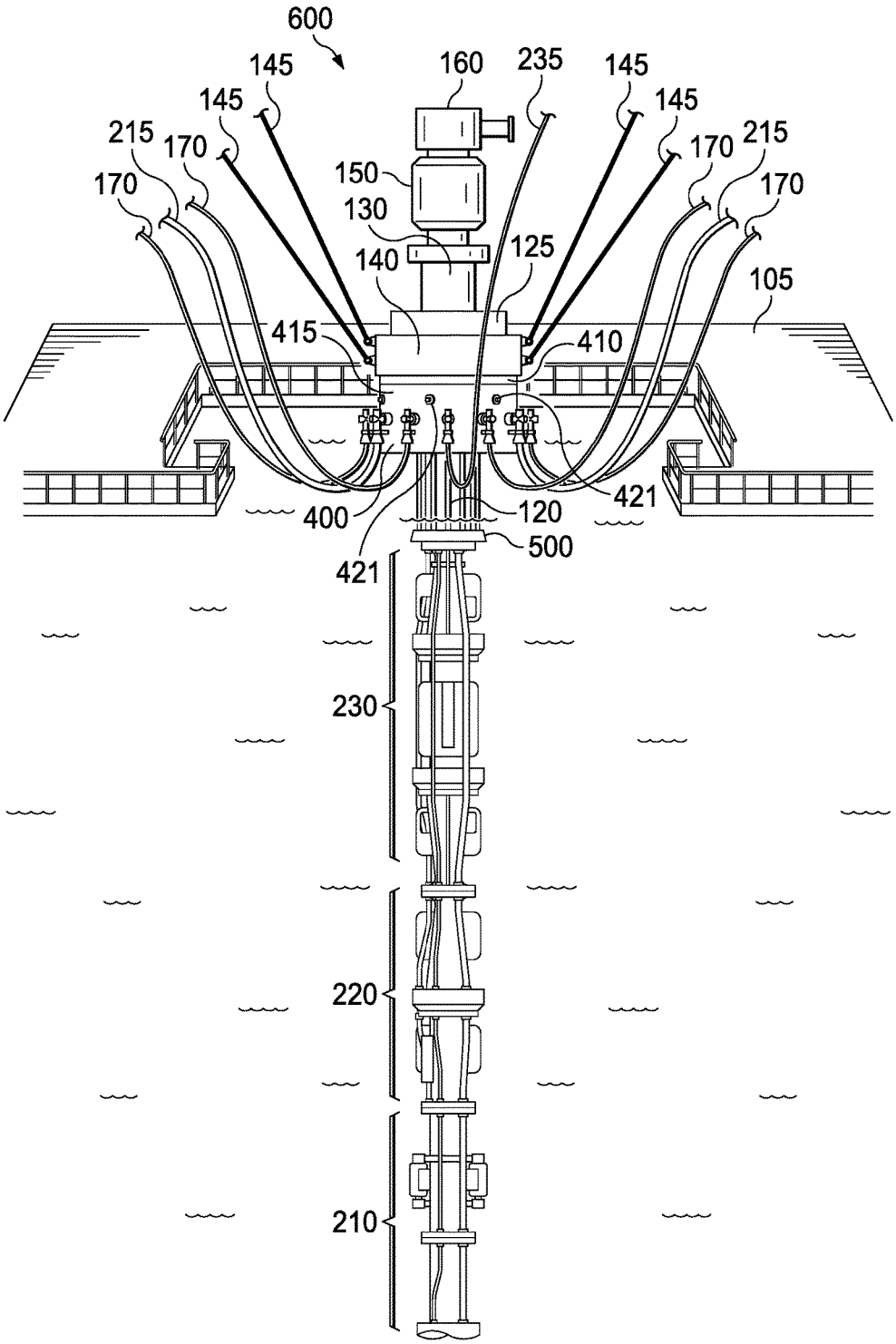
FIG. 5 shows an upper marine riser system of a below-tension-ring closed-loop hydraulic drilling system that includes a plug and play connection system in accordance with one or more embodiments of the present invention.

FIG. 5 shows an upper marine riser system 600 of a below-tension-ring closed-loop hydraulic drilling system that includes a plug and play connection system in accordance with one or more embodiments of the present invention. A floating drilling rig (not independently illustrated) may be used to drill a wellbore (not shown) into the subsea surface (not shown) to recover hydrocarbons (not shown) disposed therein. The moon pool area 105 of the floating drilling rig (not independently illustrated) may provide access to the upper marine riser system 600. The upper marine riser system 600 may include a flow diverter 160 disposed on top of, and in fluid communication with, a flex joint 150. Flex joint 150 may be disposed on top of, and in fluid communication with, an inner barrel 130 of a telescopic joint (e.g., 120, 125, and 130). Inner barrel 130 may be in fluid connection with an outer barrel 120 of the telescopic joint. Inner barrel 130 may be configured to reciprocate within an inner diameter of an outer barrel 120 to accommodate motion of the floating drilling rig (not independently illustrated) relative to the comparatively stationary MPD system (e.g., 210, 220, and 230) and marine riser system (e.g., 110 not shown) due to the heave of the body of water in which the floating drilling rig (not independently illustrated) is deployed. A tension ring 140 and a plurality of tension cables 145 may provide support to outer barrel 120 of the telescopic joint (e.g., 120, 125, and 130) and other equipment disposed below it. The plurality of tension cables 145 may connect to tensioners (not shown) disposed on the floating drilling rig (not independently illustrated) and maintain tension as the floating drilling rig (not independently illustrated) heaves relative to the comparatively stationary MPD system (e.g., 210, 220, and 230) and marine riser system (e.g., 110 not shown).

The outer barrel 120 may be in communication with an annular sealing system 230. Annular sealing system 230 may seal the annulus surrounding a drill string (not shown) disposed therethrough. Annular sealing system 230 may be a rotating control device (not shown), an active control device, or other type of annular seal (not shown). Annular sealing system 230 may controllably be in fluid communication with a drill string isolation tool 220 that provides an additional annular seal that allows the drill string (not shown) to be isolated when needed. For example, if annular sealing system 230 requires service, the sealing element (not shown) of drill string isolation tool 220 may be engaged to maintain the pressure tight seal on the annular. Drill string isolation tool 220 may be in fluid communication with a flow spool 210 disposed below the annular seal.

A marine riser system (e.g., 110 not shown) that traverses the water depth may connect flow spool 210 to a SSBOP (not shown) disposed at or near the subsea surface. The marine riser system (e.g., 110 not shown) may refer generally to the one or more tubulars or piping that connects the MPD system 210, 220, and 230 to the SSBOP (not shown). The SSBOP (not shown) may be disposed over, and in fluid communication with, a wellbore (not shown) drilled into the subsea surface (not shown). A central lumen, or interior passageway, extends through upper marine riser system 600, MPD system 210, 220, and 230, the marine riser system (e.g., 110 not shown) that traverses the water depth, the SSBOP (not shown), and into the wellbore (not shown) to facilitate drilling operations. One of ordinary skill in the art will recognize that the equipment used to maintain the annular seal and pressurized fluid return are commonly referred to in the industry as the MPD system and may include one or more of the above-noted components (e.g., 210, 220, and 230) and other components not specifically disclosed.

A plurality of fixed lines, disposed on an exterior surface of the marine riser system (e.g., 110 not shown), connect the SSBOP (not shown) to the marine riser (e.g., 110 not shown), MPD system 210, 220, 230, and potentially upper marine riser system 600. A plurality of drape hoses 170 connect, by way of the connection hub ring 400, the plurality of fixed lines to equipment disposed on the floating drilling rig (not independently illustrated). The fixed lines may include, for example, a kill line, a choke line, a booster line, and a plurality of hydraulic lines. A plurality of flow spool drape hoses 215 divert, by way of the connection hub ring 400, returning annular fluids to a choke manifold (not shown) disposed on the floating drilling rig (not independently illustrated). Because the annulus surrounding the drill string (not shown) is sealed pressure tight, wellbore pressure may be controlled by the degree to which one or more chokes (not shown) of the choke manifold (not shown) are opened or closed. In this way, wellbore pressure may be precisely maintained at a desired level without requiring the use of varying mud weights. The choke manifold (not shown) is typically connected to a mud-gas separator and other fluids systems on the floating drilling rig (not shown) that are used to remove dangerous gas from the marine riser system (e.g., 110 not shown). One or more relief hoses 235 may fluidly connect, by way of connection hub ring 400, relieve or provide pressure between sealing elements (not shown) of annular sealing system 230 or between annular sealing system 230 and drill string isolation tool 220 during, for example, replacement of a sealing element (not shown) of the annular sealing system 230. The plurality of drape hoses 170, 215, and 235 all connect to the plug and play connection system via connection hub ring 400 and include sufficient slack to accommodate the heaving motion of the floating drilling rig (not independently illustrated) relative to the comparatively stationary MPD system 210, 220, 230 and marine riser system riser (e.g., 110 not shown). In addition, one or more drape hoses 170 may comprise umbilicals (not shown) that may be used to connect to one or more of annular sealing system 230, drill string isolation tool 220, flow spool 210, or the SSBOP (not shown) to equipment disposed on the floating drilling rig (not independently illustrated).

When a component of the MPD system 210, 220, 230 requires service, installation, to be pulled, or to be replaced, one or more drape hoses 170, 215, and 235 may be easily disconnected from connection hub ring 400 and then reconnected to connection hub ring 400 once the necessary work has been performed. Because all drape hoses 170, 215, and 235 connect via connection hub ring 400, they may be easily connected and disconnected in the moon pool area 105 of the floating drilling rig (not independently illustrated), substantially reducing the amount of time required, the costs associated with, including non-productive downtime, of undertaking such actions as well as increasing the safety of operations. In this way, the plug and play connection system provides true plug and play operation, fully integrating the MPD system with the marine riser system and providing intuitive and efficient connectivity.

A method of configuring a managed pressure drilling system for use with a plug and play connection system may include attaching a connection hub flange to an outer barrel of a telescopic joint. A ported bottom flange may be attached to a bottom portion of the telescopic joint. A plurality of hub flange ports of the connection hub ring may connect to a plurality of bottom flange ports of the ported bottom flange with a plurality of conduits. A first side of a bearing ring may attach to a bottom side of a tension ring. A second side of the bearing ring may attach to a top side of a connection hub ring. The tension ring, bearing ring, and connection hub ring, now attached, may be disposed around the telescopic joint below a packer of the telescopic joint. The marine riser and MPD system may be run through the tension ring, bearing ring, and connection hub ring during installation. A plurality of drape hoses may connect a plurality of stab-in connectors of the connection hub ring to equipment disposed on a platform of the floating drilling rig. Once installed, the plurality of stab-in connectors may be hydraulically actuated to enable their fluid or other communication operations.

Advantages of one or more embodiments of the present invention may include one or more of the following:

In one or more embodiments of the present invention, a plug and play connection system provides for the plug and play operation of an MPD system with respect to drape hoses, which may be easily, efficiently, and safely connected or disconnected via the connection hub ring.

In one or more embodiments of the present invention, a plug and play connection system allows for the rapid connection or disconnection of equipment on the drilling rig to the MPD system and the SSBOP or other equipment disposed on or near the subsea floor via the connection hub ring. The drape hoses may be easily, efficiently, and safely connected or disconnected via the connection hub ring.

In one or more embodiments of the present invention, a plug and play connection system allows for the rapid connection or disconnection of equipment as part of the upper marine riser system including the telescopic joint, rotating control device, active control device, flow spool, or replaceable components thereof. Because the plug and play connection system allows for the rapid disconnection of the drape hoses from the equipment on the drilling rig to the MPD system and the SSBOP or other equipment disposed on or near the subsea floor, the equipment of the MPD system may be serviced, installed, pulled, or replaced more easily. Once the necessary work has been performed, the plug and play connection system allows for the rapid connection of the equipment on the drilling rig to the MPD system, SSBOP, or other equipment faster and more efficiently than a conventional MPD system.

In one or more embodiments of the present invention, a plug and play connection system allows for the rapid connection to the fixed lines of the SSBOP, replacing any conventional KT rings, directly receiving the fixed lines from the MPD system while shortening the flexible lines for the circulation and control of the MPD system from the rig structure.

In one or more embodiments of the present invention, the drape hoses may be pre-connected to the connection hub ring of the plug and play connection system, reducing or eliminating the time and cost associated, and then hydraulically actuated once installed.

In one or more embodiments of the present invention, a plug and play connection system reduces non-productive time and associated costs relating to servicing, installing, pulling, or replacing components of the MPD system, SSBOP, or other equipment than a conventional MPD system.

In one or more embodiments of the present invention, a plug and play connection system reduces the amount of time required to, and costs associated with, servicing, installing pulling, or replacing various components of the upper marine riser system, including the telescopic joint, as well as rotating control devices, active control devices, flow spools, or replaceable components thereof than a conventional telescopic joint and MPD system.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A plug and play connection system for a managed pressure drilling system comprising:

a connection hub flange disposed around an outer surface of an outer barrel of a telescopic joint, the connection hub flange comprising a plurality of pass-through ports and a plurality of connection hub flange ports;

a connection hub ring removably disposed around an outer surface of the connection hub flange, the connection hub ring comprising:

a plurality of dogs configured to removably attach the connection hub ring to the outer surface of the connection hub flange, and a plurality of stab-in connectors disposed around an outer surface of the connection hub ring;

a ported bottom flange connected to a bottom distal end of the outer barrel of the telescopic joint, the ported bottom flange comprising a plurality of bottom flange ports; and a plurality of conduits that connect the plurality of connection hub flange ports to the plurality of bottom flange ports, wherein the plurality of stab-in connectors are connected to the plurality of connection hub flange ports by the plurality of pass-through ports, and wherein the ported bottom flange is configured to connect, directly or indirectly, to an annular sealing system disposed below it as part of a marine riser.

2. The plug and play connection system of claim 1, further comprising:

a bearing ring configured to movably attach the connection hub ring to a tension ring configured to support a packer of the outer barrel of the telescopic joint.

3. The plug and play connection system of claim 1, further comprising:

a plurality of drape hoses, wherein each drape hose has a first distal end connected to a stab-in connector from the plurality of stab-in connectors and a second distal end connected to a device or system disposed on a platform of a floating rig.

4. The plug and play connection system of claim 1, wherein the plurality of bottom flange ports connect to one or more of a choke line, a kill line, a booster line, and a hydraulic line of a subsea blowout preventer disposed at or near a subsea surface of a wellbore.

5. The plug and play connection system of claim 1, wherein the plurality of bottom flange ports connect to one or more of a circulation line and a relief line.

6. The plug and play connection system of claim 1, wherein the plurality of bottom flange ports connect to one or more of a bearing umbilical, a rotating control device umbilical, an active control device umbilical, a control umbilical, a valve umbilical, or other umbilical.

7. A plug and play connection system riser joint for a managed pressure drilling system comprising:

an inner barrel comprising an inner barrel central lumen;

an outer barrel comprising an outer barrel central lumen, wherein the inner barrel is configured to reciprocate within the outer barrel and the inner barrel central lumen is in fluid communication with the outer barrel central lumen;

a packer disposed at a top distal end of the outer barrel that is configured to seal an annulus between the inner barrel and the outer barrel as the inner barrel reciprocates;

a tension ring configured to support the packer;

a connection hub flange disposed around an outer surface of the outer barrel, the connection hub flange comprising a plurality of pass-through ports and a plurality of hub flange ports;

a connection hub ring removably disposed around an outer surface of the connection hub flange, the connection hub ring comprising:

a plurality of dogs configured to removably attach the connection hub ring to the outer surface of the connection hub flange, and a plurality of stab-in connectors disposed around an outer surface of the connection hub ring;

a bearing ring configured to movably attach the connection hub ring to the tension ring;

a ported bottom flange connected to the bottom distal end of the outer barrel, the ported bottom flange comprising a plurality of bottom flange ports; and a plurality of conduits that connect the plurality of connection hub flange ports to the plurality of bottom flange ports, wherein the plurality of stab-in connectors are connected to the plurality of connection hub flange ports by the plurality of pass-through ports.

8. The plug and play connection system riser joint of claim 7, further comprising:

a top flange attached to a top distal end of the inner barrel.

9. The plug and play connection system riser joint of claim 7, further comprising:

a plurality of drape hoses, wherein each drape hose has a first distal end connected to a stab-in connector from the plurality of stab-in connectors and a second distal end connected to a device or system disposed on a platform of a floating rig.

10. The plug and play connection system riser joint of claim 7, wherein the packer comprises a plurality of seals.

11. The plug and play connection system riser joint of claim 7, wherein the ported bottom flange is configured to connect directly or indirectly to an annular sealing system of a marine riser.

12. The plug and play connection system riser joint of claim 7, wherein a top side of the connection hub ring is attached to a first side of the bearing ring and a second side of the bearing ring is attached to a bottom side of the tension ring.

13. The plug and play connection system riser joint of claim 7, wherein the connection hub ring, the plurality of drape hoses, and the plurality of conduits are preinstalled before installation of the managed pressure drilling system.

14. The plug and play connection system riser joint of claim 7, wherein the plurality of bottom flange ports connect to one or more of a choke line, a kill line, a booster line, and a hydraulic line of a subsea blowout preventer disposed at or near a subsea surface of a wellbore.

15. The plug and play connection system riser joint of claim 7, wherein the plurality of bottom flange ports connect to one or more of a circulation line and a relief line.

16. The plug and play connection system riser joint of claim 7, wherein the plurality of bottom flange ports connect to one or more of a bearing umbilical, a rotating control device umbilical, an active control device umbilical, a control umbilical, a valve umbilical, or other umbilical.

17. A method of retrofitting a managed pressure drilling system for use with a plug and play connection system comprising:

attaching a connection hub flange to an outer barrel of a telescopic joint;

attaching a ported bottom flange to a bottom portion of the telescopic joint;

connecting a plurality of hub flange ports of the connection hub flange to a plurality of bottom flange ports of the ported bottom flange with a plurality of conduits;

attaching a first side of a bearing ring to a bottom side of a tension ring;

attaching a second side of the bearing ring to a top side of a connection hub ring;

disposing the tension ring, bearing ring, and connection hub ring around the telescopic joint below a packer of the telescopic joint;

connecting a plurality of drape hoses that connect a plurality of stab-in connectors of the connection hub ring to equipment disposed on a platform of the floating drilling rig; and actuating the plurality of stab-in connectors.

* * * * *